US010570862B2

(12) United States Patent
Izzo

(10) Patent No.: US 10,570,862 B2
(45) Date of Patent: Feb. 25, 2020

(54) VALVE ASSEMBLY AND FLUID INJECTION VALVE

(71) Applicant: Continental Automotive GmbH, Hannover (DE)

(72) Inventor: Ivano Izzo, Pisa (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 62 days.

(21) Appl. No.: 16/064,593

(22) PCT Filed: Dec. 19, 2016

(86) PCT No.: PCT/EP2016/081657

§ 371 (c)(1),
(2) Date: Jun. 21, 2018

(87) PCT Pub. No.: WO2017/108657

PCT Pub. Date: Jun. 29, 2017

(65) Prior Publication Data

US 2018/0372043 A1 Dec. 27, 2018

(30) Foreign Application Priority Data

Dec. 21, 2015 (EP) ..... 15201786

(51) Int. Cl.
*F02M 51/06* (2006.01)
*F02M 63/00* (2006.01)

(52) U.S. Cl.
CPC ..... *F02M 51/066* (2013.01); *F02M 51/0685* (2013.01); *F02M 63/0022* (2013.01); *F02M 2200/304* (2013.01); *F02M 2200/703* (2013.01)

(58) Field of Classification Search
CPC ..... F02M 51/0653; F02M 51/066; F02M 51/0671; F02M 51/0685; F02M 63/0022; F02M 2200/304; F02M 2200/703
See application file for complete search history.

(56) References Cited

U.S. PATENT DOCUMENTS 8,430,343 B2 4/2013 Nagatomo ..... 239/585.3
2011/0278368 A1* 11/2011 Hornby ..... F02M 51/0671 239/5

(Continued)

FOREIGN PATENT DOCUMENTS

CN 102162417 A 8/2011
CN 104583575 A 4/2015

(Continued)

OTHER PUBLICATIONS

Extended European Search Report, Application No. 15201786.9, 9 pages, dated Jun. 21, 2016.

(Continued)

*Primary Examiner* — Darren W Gorman
(74) *Attorney, Agent, or Firm* — Slayden Grubert Beard PLLC

(57) ABSTRACT

A valve assembly may include: a valve body with a longitudinal axis and a cavity; a valve needle; and a driving device for displacing the valve needle. In some embodiments, the valve needle comprises a disc element. The disc element and the driving device comprise mutually facing and radially extending coupling surfaces, the coupling surfaces having an overlapping area of at least 35% of the cross-sectional area of the cavity. The driving device takes the disc element with it for displacing the valve needle in the opening direction solely by means of hydraulic interaction between the coupling surfaces when the driving device is displaced in the opening direction. The coupling surface of the driving device engages in a form-fit connection with the coupling surface of the disc element for pushing the valve needle towards the closing position.

13 Claims, 9 Drawing Sheets

(56) References Cited

U.S. PATENT DOCUMENTS

| | | | | |
|---|---|---|---|---|
| 2012/0318885 | A1* | 12/2012 | Grandi | F02M 51/066<br>239/5 |
| 2015/0102135 | A1* | 4/2015 | Romeo | F02M 51/0685<br>239/585.4 |
| 2016/0053731 | A1* | 2/2016 | Mechi | F02M 51/0671<br>239/585.5 |
| 2016/0208750 | A1* | 7/2016 | Grandi | F02M 51/0685 |

FOREIGN PATENT DOCUMENTS

| | | | | |
|---|---|---|---|---|
| DE | 102013224960 | A1 | 6/2015 | F02M 47/02 |
| EP | 2365205 | A1 | 9/2011 | F02M 51/06 |
| EP | 2597296 | A1 | 5/2013 | F02M 51/06 |
| JP | 2010096075 | A | 4/2010 | |
| JP | 2010196505 | A | 9/2010 | F02M 51/06 |
| WO | 2017/108657 | A1 | 6/1917 | F02M 51/06 |
| WO | 2013/060717 | A1 | 5/2013 | F02M 51/06 |
| WO | 2013/167597 | A1 | 11/2013 | F02M 51/06 |

OTHER PUBLICATIONS

International Search Report and Written Opinion, Application No. PCT/EP2016/081657, 13 pages, dated Apr. 5, 2017.
Chinese Office Action, Application No. 201680075404.4, 21 pages.

* cited by examiner

VALVE ASSEMBLY AND FLUID INJECTION VALVE

CROSS-REFERENCE TO RELATED APPLICATIONS

This application is a U.S. National Stage Application of International Application No. PCT/EP2016/081657 filed Dec. 19, 2016, which designates the United States of America, and claims priority to EP Patent Application No. 15201786.9 filed Dec. 21, 2015, the contents of which are hereby incorporated by reference in their entirety.

TECHNICAL FIELD

The present disclosure relates to valves. Various embodiments thereof may include a valve assembly for a fluid injection valve and a fluid injection valve comprising the valve assembly.

BACKGROUND

EP 2365205 A1 discloses an injection valve with a valve needle and an armature, the armature moving the valve needle by means of a suction force between overlapping radial surfaces of the valve needle and the armature. Conventional injection valves often suffer from long tolerance chains among several components, for example involving armature, pole piece, valve needle, etc., which may generate undesirably large part-to-part and shot-to-shot variability of the fluid quantity injected by the injection valve. The complex tolerance chains may affect hydraulic damping between surfaces of the armature and the valve needle or the pole piece, respectively, in an unpredictable way.

SUMMARY

The teachings of the present disclosure may enable an improved valve assembly for a fluid injection valve. For example, some embodiments may include an assembly (10) for a fluid injection valve (1) comprising a valve body (20) having a longitudinal axis (L) and comprising a cavity (22), a valve needle (30) received in the cavity (22), operable to seal a fluid outlet end (24) of the valve body (20) in a closing position and axially moveable relative to the valve body (20) away from the closing position in an opening direction (D) for unsealing the fluid outlet end (24), and a driving device (40) positioned in the cavity (22) for axially displacing the valve needle (30), the driving device (40) being axially moveable relative to the valve body (20) and to the valve needle (30). In some embodiments, the valve needle (30) comprises a disc element (32). In some embodiments, the disc element (32) and the driving device (40) have mutually facing and radially extending coupling surfaces (321, 401), the coupling surfaces (321, 401) having an overlapping area of at least 35% of the cross-sectional area of the cavity (22). In some embodiments, the driving device (40) is configured and arranged for taking the disc element (32) with it for displacing the valve needle (30) in the opening direction (D) solely by means of hydraulic interaction between the coupling surfaces (321, 401) when the driving device (40) is displaced in the opening direction (D). In some embodiments, the coupling surface (401) of the driving device (40) is operable to engage in a form-fit connection with the coupling surface (321) of the disc element (32) for pushing the valve needle (30) towards the closing position.

In some embodiments, the valve needle (30) is inoperable to limit axial displacement of the driving device (40) relative to the valve needle (30) in the opening direction (D).

In some embodiments, the valve needle (30) does not extend beyond the coupling surface (321) of the disc element (32) in the opening direction (D).

In some embodiments, the driving device (40) does not axially extend beyond its coupling surface (401) opposite to the opening direction (D).

In some embodiments, the driving device (40) and the valve needle (30) have no axial overlap.

In some embodiments, the valve needle (30) comprises a shaft (34) and the disc element (32) is fixed to an axial end of the shaft (34) remote from the fluid outlet end (24).

In some embodiments, the valve needle (30) comprises a shaft (34), a first stopper (38) fixed to the shaft (34) at the axial end of the valve needle (30) remote from the fluid outlet end (24), and a second stopper (39) fixed to the shaft (34) between the first stopper (38) and the axial end of the valve needle (30) adjacent to the fluid outlet end (24). In some embodiments, the disc element (32) is axially displaceable relative to the shaft (34) and positioned axially between the stoppers (38, 39), is operable to engage in form-fit and/or force-fit connection with the first stopper (38) for moving the shaft (34) in the opening direction (D), and is operable to engage in form-fit and/or force-fit connection with the second stopper (39) for moving the shaft (34) towards the closing position.

In some embodiments, there is a valve spring (60) which is operable to bias the valve needle (30) towards the closing position and a sustaining spring (64) which is configured and arranged to bias the coupling surface (321) of the disc element (32) in axial direction towards the coupling surface (401) of the driving device (40).

In some embodiments, there is an electromagnetic actuator assembly (50) which comprises a stationary pole piece (52) and a moveable armature (54), wherein the driving device (40) comprises the armature (54) or consists of the armature (54).

In some embodiments, there is a guide sleeve (70) for axially guiding the driving device (40) or the armature (54), wherein the pole piece (52) has a central axial opening (520), the guide sleeve (70) is received in the opening (520), fixed to the pole piece (52), and projects beyond the opening (520) into a central aperture (540) of the armature (54).

In some embodiments, the driving device (40) comprises an upper retainer element (42), a lower retainer element (44) and the armature (54). In some embodiments, the lower retainer element (44) comprises the coupling surface (401) of the driving device (40) and is rigidly fixed to the upper retainer element (42). In some embodiments, the armature (54) has an axial play relative to the retainer elements (42, 44), the armature (54) is operable to engage in a form-fit and/or force-fit connection with the upper retainer element (42) for displacing the upper and lower retainer elements (42, 44) in the opening direction (D), and the armature (54) is operable to engage in a form-fit and/or force-fit connection with the lower retainer element (44) for displacing the upper and lower retainer elements (42, 44 in axial direction opposite to the opening direction (D).

In some embodiments, there is an armature spring (66) which is configured and arranged to bias the armature (54) out of contact with the upper retainer element (42).

In some embodiments, the guide sleeve (70) is positioned radially between the upper retainer element (42) and the armature (54).

As another example, a fluid injection valve (1) may comprise a valve assembly (10) as described above.

BRIEF DESCRIPTION OF THE DRAWINGS

Further advantages, embodiments, and developments of the valve assembly and the fluid injection valve will become apparent from the exemplary embodiments which are described below in association with schematic figures. In the figures.

DETAILED DESCRIPTION

Figure 1A:
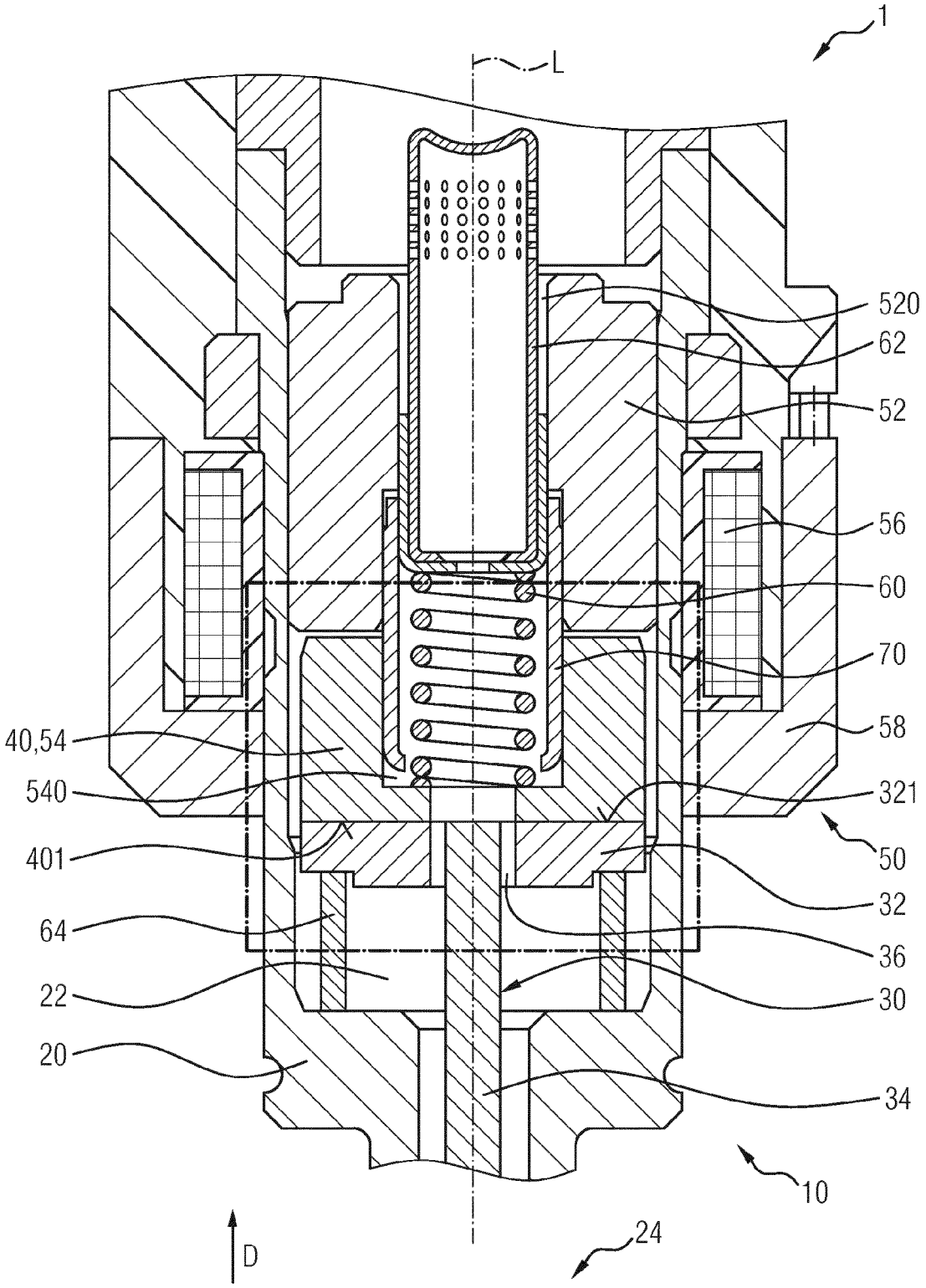
FIG. 1A shows a longitudinal section view of a portion of a fuel injection valve with a valve assembly according to teachings of the present disclosure.

In some embodiments, a fluid injection valve comprises a fuel injection valve. The fuel injection valve may be used for injecting fuel directly into a combustion chamber of an internal combustion engine.

In some embodiments, the valve assembly comprises a valve body which has a longitudinal axis and comprises a cavity. The valve assembly further comprises a valve needle which is received in the cavity. The valve needle is operable to seal a fluid outlet end of the valve body in a closing position. The valve needle is axially moveable relative to the valve body away from the closing position in an opening direction for unsealing the fluid outlet end.

In some embodiments, the valve assembly comprises a driving device. The driving device is positioned in the cavity for axially displacing the valve needle. The driving device is axially moveable relative to the valve body. It is also axially movable relative to the valve needle.

In some embodiments, the valve needle comprises a disc element. The disc element and the driving device have mutually facing and radially extending coupling surfaces. Each of the coupling surfaces may comprise a planar surface. The coupling surfaces may be coplanar.

In some embodiments, the coupling surfaces have—in particular in top view along the longitudinal axis—an overlapping area of at least 35%, preferably of at least 40%, of the cross-sectional area of the cavity. In one embodiment, the overlapping area has a value of 90% or less of the cross-sectional area of the cavity. The cross-sectional area is to be understood to be the cross-sectional area of the cavity in a plane between the coupling surfaces or comprising one of the coupling surfaces, the plane perpendicular to the longitudinal axis.

In some embodiments, between an inner contour and an outer contour of the overlapping area, the coupling surfaces may be unperforated. In this way, fluid can flow into an axial gap between the coupling surfaces only in radial direction from the inner contour and/or the outer contour.

In some embodiments, the driving device takes the disc element with it for displacing the valve needle in the opening direction solely by means of hydraulic interaction between the coupling surfaces when the driving device is displaced in the opening direction. To put it differently, when the driving device moves in the opening direction, its coupling surface moves away from the coupling surface of the disc element so that it creates a suction force—sometimes also denoted as "hydraulic sticking"—acting on the coupling surface of the disc element for moving the disc element in the opening direction.

In some embodiments, the coupling surface of the driving device engages in a form-fit connection with the coupling surface of the disc element for pushing the valve needle towards the closing position. However, the valve needle may be inoperable to limit axial displacement of the driving device relative to the valve needle in the opening direction.

In some embodiments, by means of the coupling surfaces of the driving device and the disc element, improved behavior of the valve assembly during the opening transient is achievable. In particular, a time dependency of the velocity of the valve needle is achievable which is different from the time dependency of the velocity of the driving device during the opening transient. In conventional fuel injection valves, a nonlinearity of the flow rate in dependence on the valve opening time may, for example occur due to the armature hitting the pole piece. Due to the special design of the subject valve assembly—in particular regarding the coupling surfaces—such a nonlinearity may be particularly small or completely avoided. With advantage, a particularly precise and reproducible flow rate is achievable in this way.

In some embodiments, the valve needle does not extend beyond the coupling surface of the disc element in the opening direction. In some embodiments, the driving device does not axially extend beyond its coupling surface opposite to the opening direction. To put it differently, in case of an inward opening valve, the coupling surface of the disc element represents the end surface of the valve needle which defines the axial end of the valve needle remote from the fluid outlet end and/or the coupling surface of the driving device represents the end surface of the driving device which defines the axial end of driving device facing towards the fluid outlet end. In an expedient embodiment, there is no axial overlap between the driving device and the valve needle. With advantage, particularly precise parallel orientation of the coupling surfaces and/or a particularly large overlapping area and/or particularly easy alignment of the coupling surfaces is/are achievable in this way.

In some embodiments, the valve needle comprises a shaft and the disc element is fixed to an axial end of the shaft remote from the fluid outlet end. In some embodiments, the shaft does not protrude from the disc element in axial direction away from the fluid outlet end. In this way, a particularly short valve needle is achievable, contributing to an advantageously small size of the valve assembly. The risk that a portion of the valve needle may interfere with the coupling between the coupling surfaces of the disc element and the driving device is particularly small.

In some embodiments, the valve needle comprises a shaft and further comprises a first stopper and a second stopper. The first stopper is fixed to the shaft at the axial end of the valve needle remote from the fluid outlet end. The second stopper is fixed to the shaft between the first stopper and the axial end of the valve needle adjacent to the fluid outlet end. That the first stopper or the second stopper, respectively, is "fixed to the shaft" is understood to include embodiments in which the first stopper or the second stopper, respectively, is in one piece with the shaft. However, it is preferable that at least one of the first and second stoppers is a separate part which is attached to the shaft during assembly—in particular after shifting the disc element over the shaft.

In some embodiments, the disc element is axially displaceable relative to the shaft and positioned axially between the stoppers. The disc element is operable to engage in form-fit and/or force-fit connection with the first stopper for moving the shaft in the opening direction. It is operable to engage in form-fit and/or force-fit connection with the second stopper for moving the shaft towards the closing position. In this way, momentum transfer due to the impact of the valve needle on a hard stop at the end of the opening transient and/or of the closing transient may be particularly small.

In some embodiments, the disc element is spaced apart from the first stopper when the valve assembly is in a closed configuration. In this way, a free lift of the disc element is achievable so that the disc element is accelerated and moves in the opening direction at the beginning of the opening transient while the shaft of the valve needle is still at rest in the closing position. In this way, a particularly large momentum transfer from the disc element to the shaft is achievable at the beginning of the opening transient of the shaft. This is advantageous for valve assemblies—in particular inward opening valve assemblies—which operate at large fluid pressures, such as 300 bar and above, for example between 350 and 500 bar.

In some embodiments, the valve assembly comprises a valve spring which is operable to bias the valve needle towards the closing position. In some embodiments, the valve assembly also comprises a sustaining spring which is configured and arranged to bias the coupling surface of the disc element in axial direction towards the coupling surface of the driving device. In this way, the coupling surfaces may be reliably retained in form-fit connection when the valve assembly is at rest in the fully open configuration in which the driving device is in particular inoperable to excert a force in the opening direction on the valve needle.

In some embodiments, the valve assembly or the fluid injection valve, respectively, comprises an actuator assembly. In some embodiments, the actuator assembly is a piezoelectric actuator assembly. In this case, the driving device may be mechanically connected—e.g. rigidly fixed—to a piezostack.

In some embodiments, the actuator assembly comprises an electromagnetic actuator assembly. The electromagnetic actuator assembly comprises a stationary pole piece and a moveable armature. In some embodiments, the driving device may comprise the armature. In some embodiments, the armature may be positioned inside the valve body and axially movable relative to the valve body in reciprocating fashion. With advantage, the valve needle of the subject valve assembly is not axially guided by being in sliding contact with the pole piece, contrary to conventional valve assemblies. This reduces the complexity of the tolerance chain.

In some embodiments, the valve assembly further comprises a guide sleeve for axially guiding the driving device. In some embodiments, the guide sleeve is operable to guide the armature axially. In some embodiments, the pole piece may have a central axial opening, the guide sleeve being received in the central axial opening, being fixed to the pole piece, and projecting beyond the opening into a central aperture of the armature. In this way, axial guiding of the driving device/the armature is independent of the valve needle.

In some embodiments, the valve needle is not used for axially guiding the armature. Therefore, axial guiding tolerances between the armature and the needle are avoided which otherwise have the risk to interfere with a coplanar orientation of the coupling surfaces.

In some embodiments, the guide sleeve and the driving device are shaped and arranged to enable tilting of the driving device, in particular of its coupling surface, relative to the longitudinal axis. In this way, a particularly precise coplanar orientation of the coupling surfaces of the disc element and the driving device is easily achievable.

In some embodiments, the driving device comprises an upper retainer element, a lower retainer element, and the armature. The lower retainer element comprises the coupling surface of the driving device and is rigidly fixed to the upper retainer element, e.g. by a press-fit connection and/or a welded connection. The armature has an axial play relative to the retainer elements. It is operable to engage in a form-fit and/or force-fit connection with the upper retainer element for displacing the upper and lower retainer elements in the opening direction, and it is operable to engage in a form-fit and/or force-fit connection with the lower retainer element for displacing the upper and lower retainer elements in axial direction opposite to the opening direction. In some embodiments, the valve assembly further comprises an armature spring which is configured and arranged to bias the armature away from the upper retainer element. Thus, the armature is in particular out of contact with the upper retainer element when the actuator assembly is deenergized. In this way, a free lift of the armature is achievable so that the armature is accelerated and moves in the opening direction at the beginning of the opening transient while the retainer elements are still at rest. In this way, a particularly large momentum transfer from the armature to retainer elements and, in turn, to the valve needle is achievable at the beginning of the opening transient.

In some embodiments, the guide sleeve is positioned radially between the upper retainer element and the armature, in particular for axially guiding the upper retainer element and/or the armature. The guide sleeve and the retainer element are easily shapeable in a way to avoid jamming of the elements during relative axial movement. For example, the upper retainer element may have a convexly curved—e.g. spherical—outer surface which is in sliding contact with an inner circumferential surface of the guide sleeve. In some embodiments, the guide sleeve, the upper retainer element, and the armature are shaped and positioned such that the guide sleeve axially guides both, the armature and the upper retainer element.

For example, in some embodiments, a circumferential surface of the central aperture of the armature is in sliding contact with an outer circumferential surface of the guide sleeve and the curved surface of the upper retainer element is in sliding contact with said inner circumferential surface of the guide sleeve. With advantage, a particularly precise guiding of both, the armature and the upper retainer element, with a comparably small number of parts is achievable in this way. Different tilt angles of the armature and the coupling surface of the driving device with respect to the longitudinal axis are achievable in this way. With advantage, a particularly precise parallel extension of the coupling surfaces of the lower retainer element and the disc element is achievable while the mutually facing end surfaces of armature and pole piece which contact in the fully open configuration of the valve assembly may also extend particularly precisely parallel to one another but do not need to be precisely parallel to the coupling surfaces.

In the exemplary embodiments and figures, similar, identical, or similarly acting elements are provided with the same reference symbols. In some figures, individual reference symbols may be omitted to improve the clarity of the figures.

FIG. 1A shows a longitudinal section view of a fluid injection valve 1 which comprises a fuel injection valve to inject gasoline directly into a combustion chamber of an internal combustion engine. Only a central portion of the fluid injection valve 1 is shown in FIG. 1A, its fluid inlet end and its fluid outlet end 24 being outside of the range depicted in FIG. 1A. The fluid injection valve 1 comprises a valve assembly 10. A detail of the valve assembly 10 is shown on a larger scale in FIG. 1B. The valve assembly 10 comprises a valve body 20, a valve needle 30 and a driving device 40.

The valve body 20 has a longitudinal axis L. It comprises a cavity 22 which hydraulically connects the fluid inlet end of the fluid injection valve 1 with the fluid outlet end 24 of the valve body 20.

The valve needle 30 is received in the cavity 22. It is operable to seal the fluid outlet end 24 of the valve body 20 in a closing position. It is axially movable relative to the valve body 20, away from the closing position, in an opening direction D for unsealing the fluid outlet end 24. The valve assembly 10 is an inward opening valve assembly, i.e. the opening direction D is directed from the fluid outlet end 24 towards the fluid inlet end of the valve body 20 so that a sealing element of the valve needle 30 which is in sealing contact with a valve seat of the valve assembly 10 moves in axial direction towards the fluid inlet end for unsealing the fluid outlet end 24.

In FIG. 1, the driving device 40 is represented by an armature 54 of an electromagnetic actuator assembly 50. The armature 54 is positioned in the cavity 22 of the valve body 20. The electromagnetic actuator assembly 50 further comprises a stationary pole piece 52 which is fixed to the valve body 20 inside the cavity 22. It further comprises a coil 56 extending circumferentially around the valve body 20 and a magnetic coil housing 58 in which the coil 56 is positioned. The coil housing 58 represents a yoke of the actuator assembly 50.

The driving device 40 is positioned axially between the valve needle 30 and the pole piece 52. In FIG. 1, it neither has axial overlap with the pole piece 52 nor with the valve needle 30. "Axial overlap" is understood to mean overlap in a side view perpendicular to the longitudinal axis L in the present context.

The driving device 40—i.e. the armature 54—is guided axially by means of a guide sleeve 70 which protrudes from the central opening 520 of the pole piece 52 and is press-fitted into the central opening 520 of the pole piece 52. Specifically, the guide sleeve 70 projects axially into a central aperture 540 of the armature 54. An outer circumferential surface of the guide sleeve 70 and the circumferential surface of the central aperture 540 of the armature 54 are in sliding mechanical contact for axially guiding the armature 54.

In addition to the disc element 32, the valve needle 30 comprises a shaft 34. The shaft 34 extends from the sealing element of the valve needle 30 to an axial end remote from the fluid outlet end 24. The sealing element is in sealing mechanical contact with the valve seat of the valve assembly 10 when the valve needle 30 is in the closing position. The sealing element may be in one piece with the shaft 34 or it may be fixed to the shaft 34. It is not positioned in the portion of the valve assembly 10 shown in FIG. 1A so that the sealing element is not visible in the figures. The disc element 32 is positioned at and fixed to the axial end of the shaft 34 remote from the fluid outlet end 24. For example, the disc element 32 is fixed to the shaft 34 by means of a pressfit connection C. At the interface between the shaft 34 and the disc element 32, fluid channels 36 are provided in the valve needle 30 which allow fluid flow in axial direction through the disc element 32.

The disc element 32 has a coupling surface 321. The coupling surface 321 of the disc element 32 is a planar surface which extends in radial direction—i.e. it is perpendicular to the longitudinal axis L—and faces away from the fluid outlet end 24. The coupling surface 321 of the disc element 32 is coplanar to a coupling surface 401 of the driving device 40. The coupling surface 401 of the driving device 40 faces towards the coupling surface 321 of the disc element 32—i.e. towards the fluid outlet end 24 in the present embodiment.

Figure 1B:
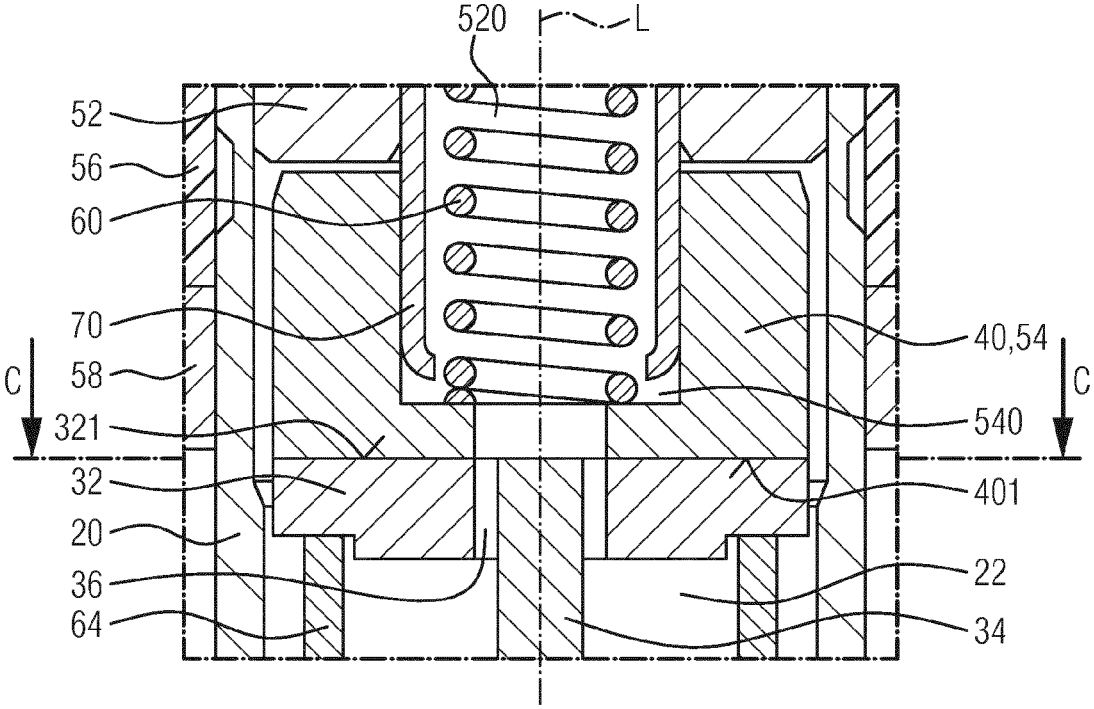
FIG. 1B shows a detail of the valve assembly in a longitudinal section view.
Figure 1C:
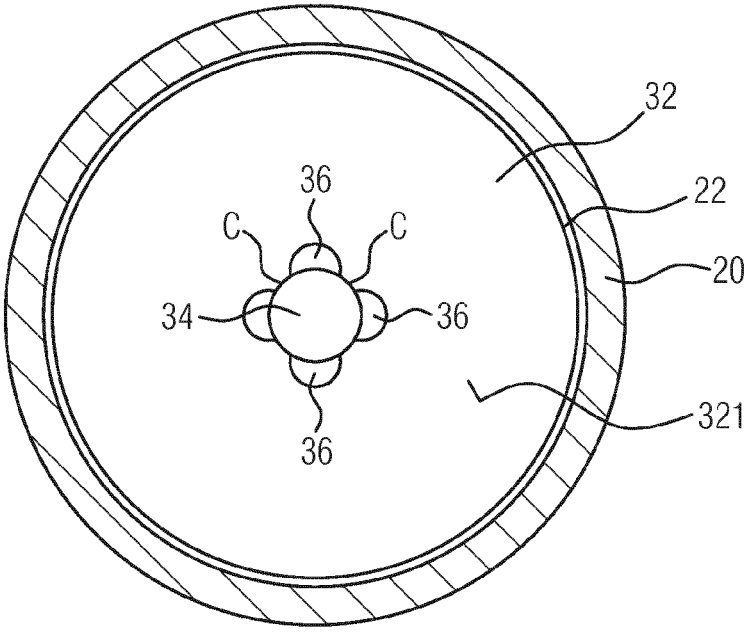
FIG. 1C shows a cross-sectional view of the valve assembly.

FIG. 1C shows a cross-sectional view of the valve assembly 10 in the plane of the coupling surface 321 of the disc element 32 (i.e. the plane C-C indicated in FIG. 1B).

The coupling surfaces 321, 401 of the disc element 32 and the driving device 40 overlap laterally, in top view along the longitudinal axis. In FIG. 1C, the inner contour of the overlapping area of the coupling surfaces 321, 401 of the disc element 32 and the driving device 40, respectively, is indicated by the dashed lines. The outer contour of the overlapping area coincides with the outer contour of the coupling surface 321 of the disc element 32. In FIG. 1, the overlapping area has a value of approximately 42% of the cross-sectional area of the cavity 22 in the plane of the coupling surface 321 of the disc element 32.

The driving device 40 and, thus, the armature 54 are delimited in axial direction towards the fluid outlet end 24 by the coupling surface 401 of the driving device 40. The coupling surface 321 of the disc element 32 delimits the disc element 32 and the valve needle 30 in axial direction away from the fluid outlet end. The valve needle 30 does not extend beyond the coupling surface 321 of the disc element 32 in the opening direction D. Driving device 40 does not extend axially beyond its coupling surface 401 in axial direction opposite to the opening direction D.

The valve assembly 10 further comprises a valve spring 60 seated against the driving device 40—in FIG. 1 against the armature 54—and against a calibration tube 62 on opposite axial ends. The calibration tube 62 is press fitted into a central opening 520 of the pole piece 52. During assembling the valve assembly 10, the calibration tube 62 can be displaced axially relative to the pole piece 52 for setting a preload of the valve spring 60. By means of the valve spring 60, the coupling surface 401 of the driving device 40—i.e. the armature 54 in the present embodiment—is pressed against the coupling surface 321 of the disc element 32 of the valve needle 31 when the valve assembly 10 is in a closed configuration. In this way, the coupling surface 401 of the driving device 40 is also operable to engage in a form-fit connection with the coupling surface 321 of the disc element 32 for pushing the valve needle 30 towards the closing position.

Further, the valve assembly 10 comprises a sustaining spring 64 which is seated against the disc element 32 and against the valve body 20 on its opposite axial ends for biasing the coupling surface 321 of the disc element 32 in axial direction towards the coupling surface 401 of the driving device 40—for biasing the valve needle in the opening direction D. Expediently, the spring rate and preload of the sustaining spring 64 and the spring rate and preload of the valve spring 60 are selected such that the spring force of the valve spring 60 is larger than the spring force of the sustaining spring 64 for securely retaining the valve assembly 10 in the closing configuration while the actuator assembly 50 is deenergized.

The driving device 40 and the valve needle 30 are axially displaceable relative to one another. The driving device 40 is configured and arranged for taking the disc element 32 with it to displace the valve needle 30 in the opening direction D solely by means of hydraulic interaction between the coupling surfaces 321, 401 when the driving device 40 is displaced in the opening direction D. At the same time, the valve needle 30 is inoperable to limit axial displacement of the driving device 40 relative to the valve needle 30 in the opening direction D.

The opening transient of the valve assembly 10 is now described in connection with the schematic diagram the presented in FIG. 2.

Figure 2:
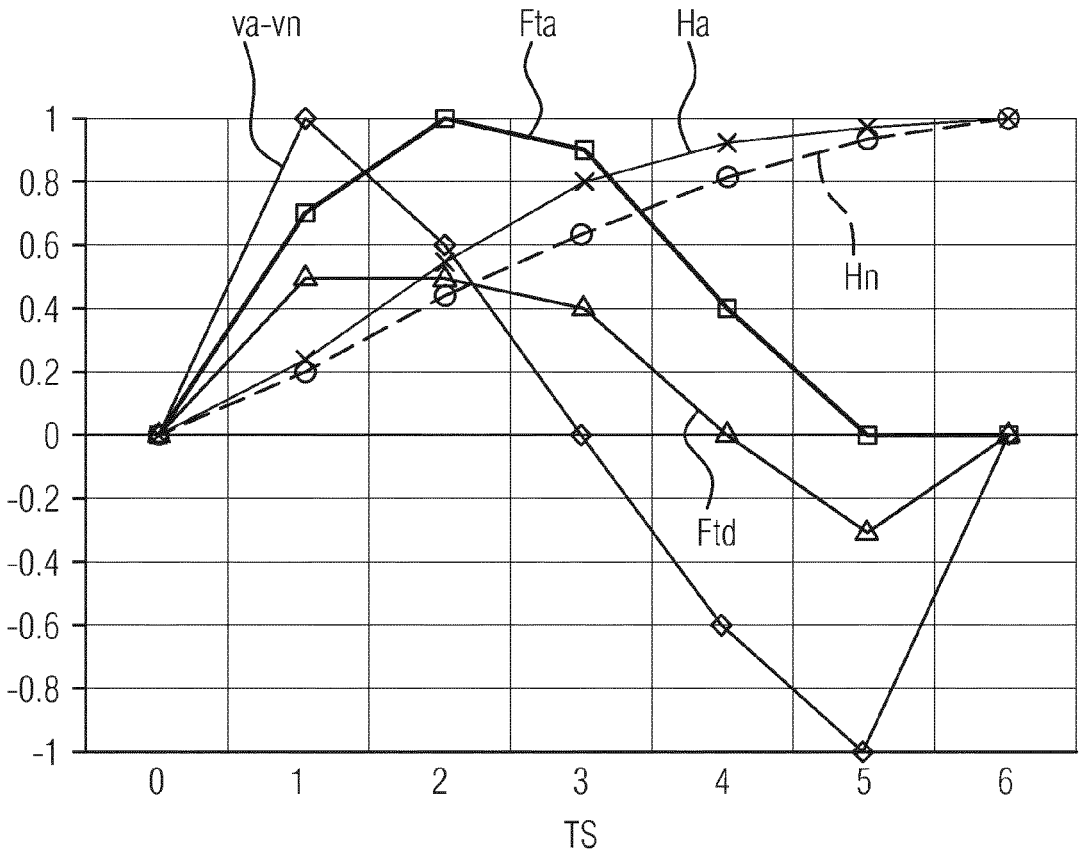
FIG. 2 shows a schematic representation of the time dependence of the armature position, the needle position and the forces on the armature and needle during an opening transient of the valve assembly according to teachings of the present disclosure.

While the opening transient is a continuous movement, it is represented as the sequence of time steps TS in FIG. 2 for the sake of simplicity. The subsequent time steps TS are given dimensionless numbers in FIG. 2. FIG. 2 shows—in qualitative fashion, only giving dimensionless units on the ordinate of the diagram shown in FIG. 2—the time dependency of the armature position Ha, the needle position Hn, the total force Fta on the armature 54, the total force Ftd on the disc element 32, and the difference va−vn of the velocity of the armature 54 (va) and the velocity of the disc element 32 (vn).

When the actuator assembly 50 is not energized, the preloaded valve spring 60 presses the coupling surface 401 of the armature 54 against the coupling surface 321 of the disc element 32 of the valve needle 30 so that the sealing element of the valve needle 30 is pressed against the valve seat of the valve assembly 10 and the fluid outlet end 24 is sealed. The spring force transferred to the disc element 32 by the sustaining spring 64 in the opening direction D is smaller than the force effected by the valve spring 60 and transferred by the driving device 40 to the disc element 32 in the opposite direction when the actuator assembly 50 is not energized. In this way, the so-called "normally closed" configuration of the valve assembly 10 is guaranteed even without hydraulic pressure contributing to closing the valve. This corresponds to the time step TS labeled with "0" in FIG. 2.

When the actuator assembly 50 is energized for moving the valve needle 30 away from the closing position, an operating current is fed to the coil 56 for generating a magnetic field. This corresponds to time step TS 1. The magnetic field attracts the armature 54 towards the pole piece 52, represented by the total force Fta on the armature 54.

In the closing configuration, there is an axial gap between the armature 54 and the pole piece 52; more specifically, the gap is in particular defined by mutually facing end surfaces of the armature 54 and the pole piece 52. Due to the force generated by the magnetic field, the armature 54 is accelerated and displaced towards the pole piece 52, represented by the change in armature position Ha between time steps TS 0 and 1.

The quick increase of the magnetic force on the armature 54 effects a quick increase of the differential velocity va−vn between the armature 54 and the disc element 32, the latter tending to stay at rest due to its inertia and the fluid pressure acting on the sealing element of the valve needle 30. However, the increasing differential velocity va−vn between the armature 54 disc element 32 also leads to a hydraulic sticking force acting on the disc element 32. The "hydraulic sticking force" is in particular effected by the coupling of the coupling surfaces 321, 401 by means of the fluid between them, e.g. by adhesion and cohesion forces. The hydraulic sticking allows transferring forces in the opening direction D from the coupling surface 401 of the driving device 40 to the coupling surface 321 of the disc element 32.

After the hydraulic sticking force has increased to overcome the inertia and the fluid pressure acting on the sealing element, the driving device 40 takes the disc element 32 with it in the opening direction D solely by means of the hydraulic sticking force between the coupling surfaces 321, 401, resulting in a position change of the position Hn of the valve needle 30.

While the driving device 40 and the disc element 32 move, the armature 54 is accelerated further—corresponding to an increasing total force Fta on the armature 54 between time steps TS 1 and 2—so that the velocity of the armature 54 increases. However, fluid continuously enters between the coupling surfaces 321, 401. Due to the increasing distance between the coupling surfaces 321, 401, the hydraulic sticking force decreases. Therefore, the valve needle 30 is not accelerated, but moves further in the opening direction with constant or even decreasing acceleration, the acceleration corresponding to the total force Ftd on the valve needle 30.

When the armature 54 further approaches the pole piece 52, the gap between the end surfaces of the armature 54 and the pole piece 52 is reduced to a size which enables hydraulic damping of the armature 54 by means of the fluid between the approaching end surfaces. The hydraulic damping interaction between the armature 54 and the pole piece 52 leads to a reduction of the armature velocity to the same value as the velocity of the disc element 32. Thus, the coupling surfaces 321, 401 travel with the same velocity so that no force transfer via the fluid in the gap between the coupling surfaces 321, 401 occurs. This corresponds to time step TS 3 where the velocity difference va−vn of armature 40 and disc element 32 is zero.

Subsequently, the armature 54 is dampened further, in time step TS 4, until it hits the pole piece 52 in time steps TS 5. During this period of time, the valve needle 30 with the disc element 32—due to inertia and the spring force of the sustaining spring 64—move faster towards the pole piece 52 than the armature 54, corresponding to the negative value of the velocity difference va−vn. This effects a decrease of the gap width between the coupling surfaces 321, 401. Fluid is squeezed out of the gap, thereby effecting a hydraulic damping of the movement of the disc element 32.

When the armature 54 hits the pole piece 52 in time step TS 5, the disc element 32 is strongly decelerated due to the strong increase of the damping force effected by the abrupt stopping of the armature 54 when it comes into contact with the pole piece 52. The valve needle 30 continues its strongly damped movement towards the pole piece 52—driven by its inertia and the spring force of the sustaining spring 64—until the gap between the coupling surfaces 321, 401 is completely closed again; this corresponds to time step TS 6.

Figure 3A:
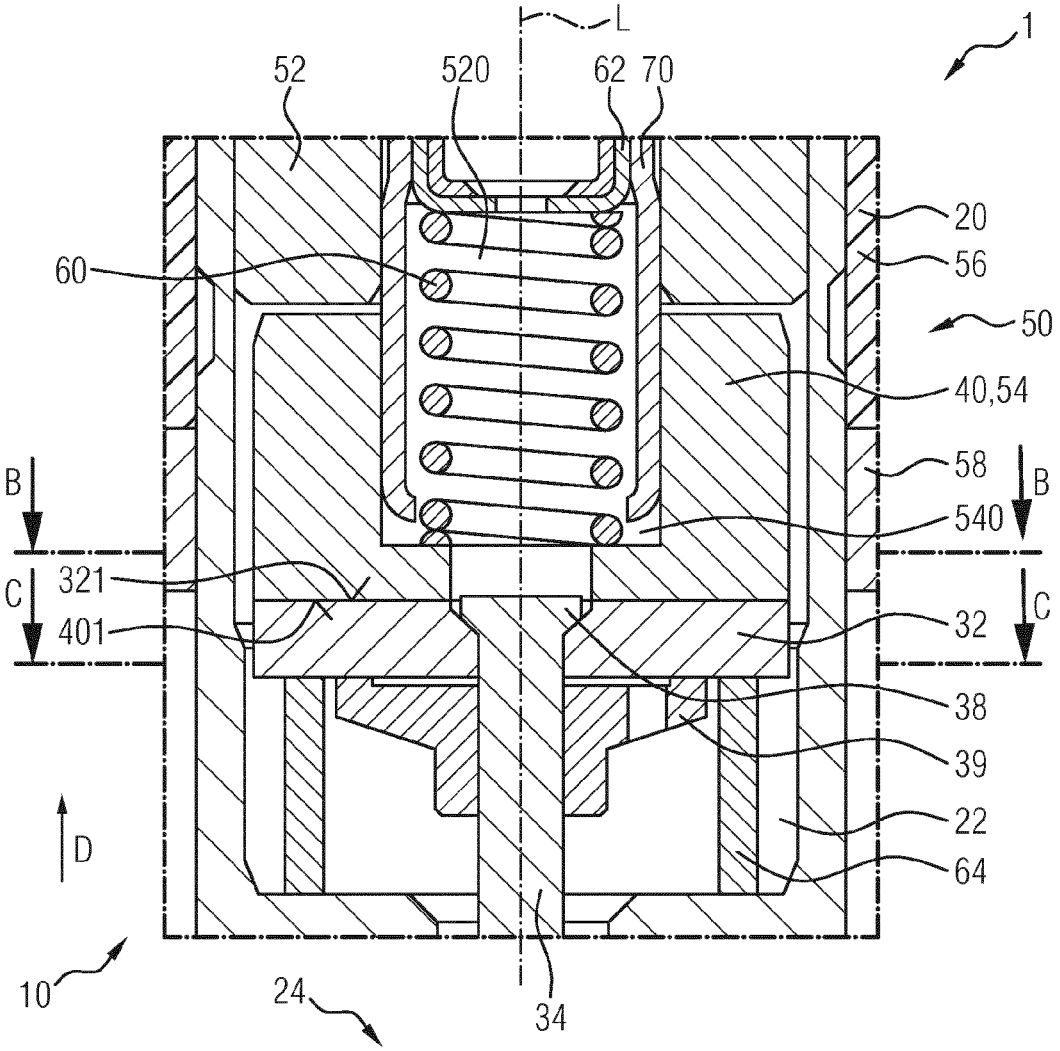
FIG. 3A shows a longitudinal section view of a portion of a fuel injection valve with a valve assembly according to teachings of the present disclosure.
Figure 3B:
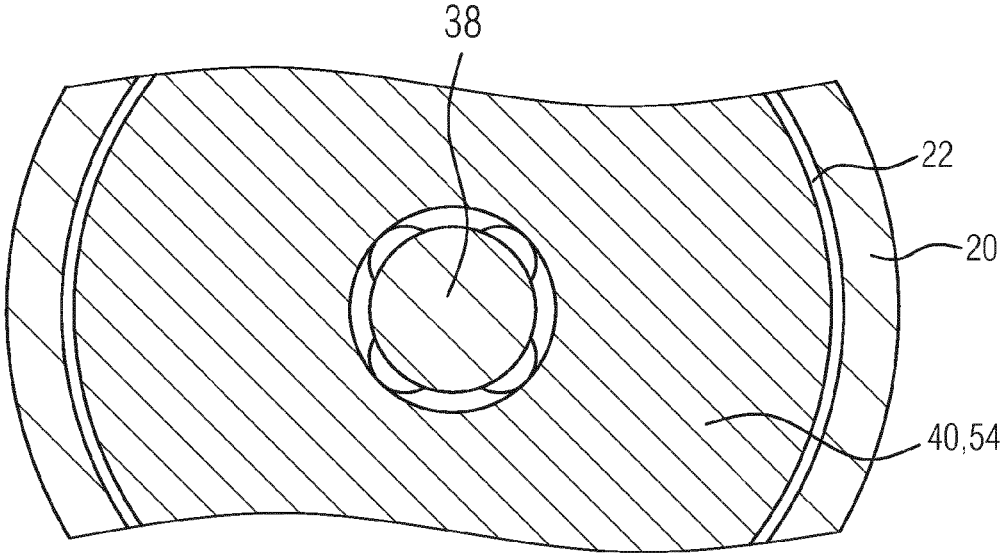
FIG. 3B shows a first cross-sectional view of the valve assembly.
Figure 3C:
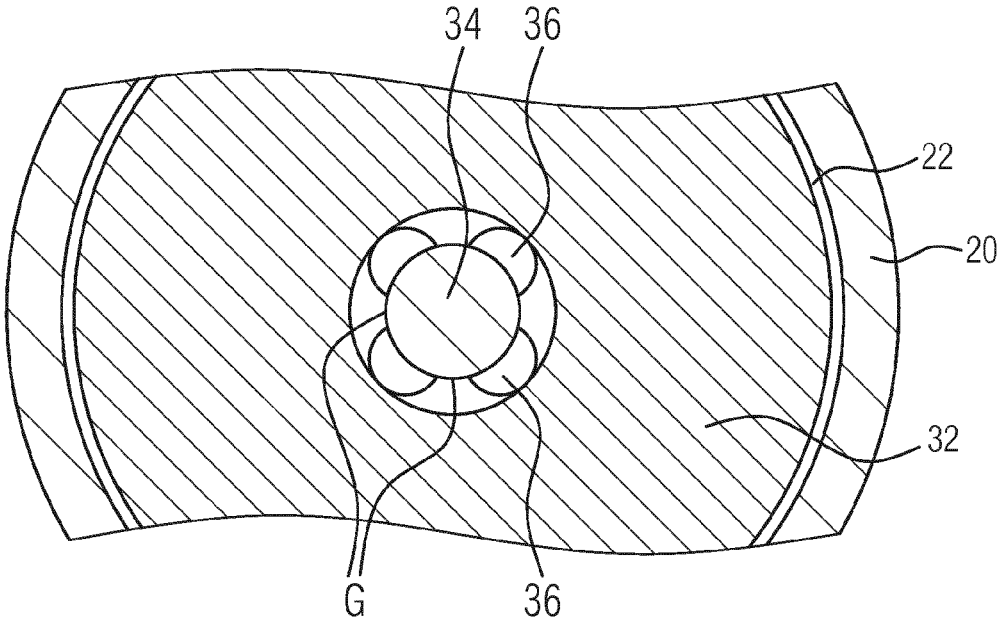
FIG. 3C shows a second cross-sectional view of the valve assembly.

FIGS. 3A, 3B and 3C show a fluid injection valve 1 with a valve assembly 10 according to teachings of the present disclosure. FIG. 3A shows the fluid injection valve 1 in a longitudinal section view with respect to the longitudinal axis L of the valve body 20. FIG. 3B shows a cross-sectional view in the plane B-B indicated in FIG. 3A and FIG. 3C shows a cross-sectional view in the plane C-C indicated in FIG. 3A.

The valve assembly 10 and the fluid injection valve 1 of the second embodiment correspond in general to the fluid injection valve 1 and the valve assembly 10 of the first embodiment. However, in FIG. 3, the disc element 32 of the valve needle 30 is not rigidly fixed to the shaft 34 of the valve needle 30. Rather, the valve needle 30 comprises a first stopper 38 at the axial end of the shaft 34 remote from the fluid outlet end 24. In the present embodiment, the first stopper 38 is in one piece with the shaft 34 and represented by a collar protruding laterally beyond the shaft 34.

In addition, the valve needle 30 comprises a second stopper 39 which is fixed to the shaft 34 between the first stopper 38 and the axial end of the valve needle 30 which is adjacent to the fluid outlet end 24. The second stopper 39 is represented by a ring element through which the shaft 34 extends and which is rigidly fixed to the shaft 34 by means of a press-fit connection and/or a welded connection.

The disc element 32 is positioned axially between the stoppers 38, 39. The shaft 34 extends axially through the disc element 32 and the disc element 32 is axially displaceable relative to the shaft 34. In particular, the disc element 32 has an axial play between the stoppers 38, 39. The shaft 34 is in sliding contact with guide portions G of the disc element 32 which are positioned between the fluid channels 36 in circumferential direction.

The disc element 32 laterally overlaps the first stopper 38 and the second stopper 39 so that it is operable to engage in form-fit and/or force-fit connection with the first stopper 38 and with the second stopper 39. In FIG. 3, the disc element 32 and the first stopper 38 have mutually facing inclined or curved surfaces—in particular a conical and a spherical surface, respectively—which are operable to engage in form-fit and force-fit connection on the side of the disc element 32 remote from the second stopper 39. The disc element 32 and the second stopper 39 are configured to engage into a form-fit connection by means of respective radially extending stopping surfaces of the disc element 32 and the second stopper 39. The stopping surface of the disc element 32 comprises a surface parallel to the coupling surface 321 on the side of the disc element 32 remote from the coupling surface 321.

The stopping surface of the second stopper 39 may include a ring-shaped surface comprising an outer circumference of the second stopper 39. It may enclose a recess for establishing an axial gap between the disc element 32 and the second stopper 32 in the region of the recess. The second stopper 39 also has an axial bore extending from the recess to a side of the second stopper 39 facing away from the disc element 32. In this way, hydraulic sticking between the second stopper 39 and the disc element 32 is particularly small.

By means of the form-fit and force-fit connection with the first stopper 38, the disc element 32 is operable to move the shaft 32 in the opening direction. By means of the form-fit connection with the second stopper 39, disc element 32 is operable to move the shaft 34 towards the closing position, i.e. opposite to the opening direction D in axial direction.

When the valve assembly 10 is in the closed configuration, the valve spring 60 presses the disc element 32 against the second stopper 39, the spring force being transferred to the disc element 32 via the coupling surfaces 321, 401 of the driving device 40 and the disc element 32. In this way, a gap is established between the first stopper 38 and the disc element 32.

When the actuator assembly 50 is energized—so that the driving device 40 moves the disc element 32 in the opening direction D as described in detail in connection with the first embodiment—, the disc element 32 moves axially relative to the shaft 34 until the gap between the disc element 32 and the first stopper 38 is closed. During this travel of the disc element 32, the shaft 34 is retained in its position by the hydraulic force of the fluid in the cavity 22 pressing the sealing element of the valve needle 30 onto the valve seat of the valve assembly 10.

When the disc element 32 hits the first stopper 38, a large momentum is transferred to the sealing element via the shaft 34 which displaces the sealing element out of contact with the valve seat to open the fluid outlet end 24. Subsequently, the shaft 34 (and the sealing element which is fixed to the shaft) move together with the disc element 32 in the opening direction D as described in detail in connection with FIG. 1.

When the connection surface 321 of the disc element 32 hits the connection surface 401 of the driving device 40 at the end of the opening transient (as described in detail in connection with the first embodiment), the rest of the valve needle 30 can still move further in the opening direction D until the disc element 32 comes into contact with the stopping surface of the second stopper 39. This may contribute to dampen the impact of the valve needle 30 even further.

Figure 4A:
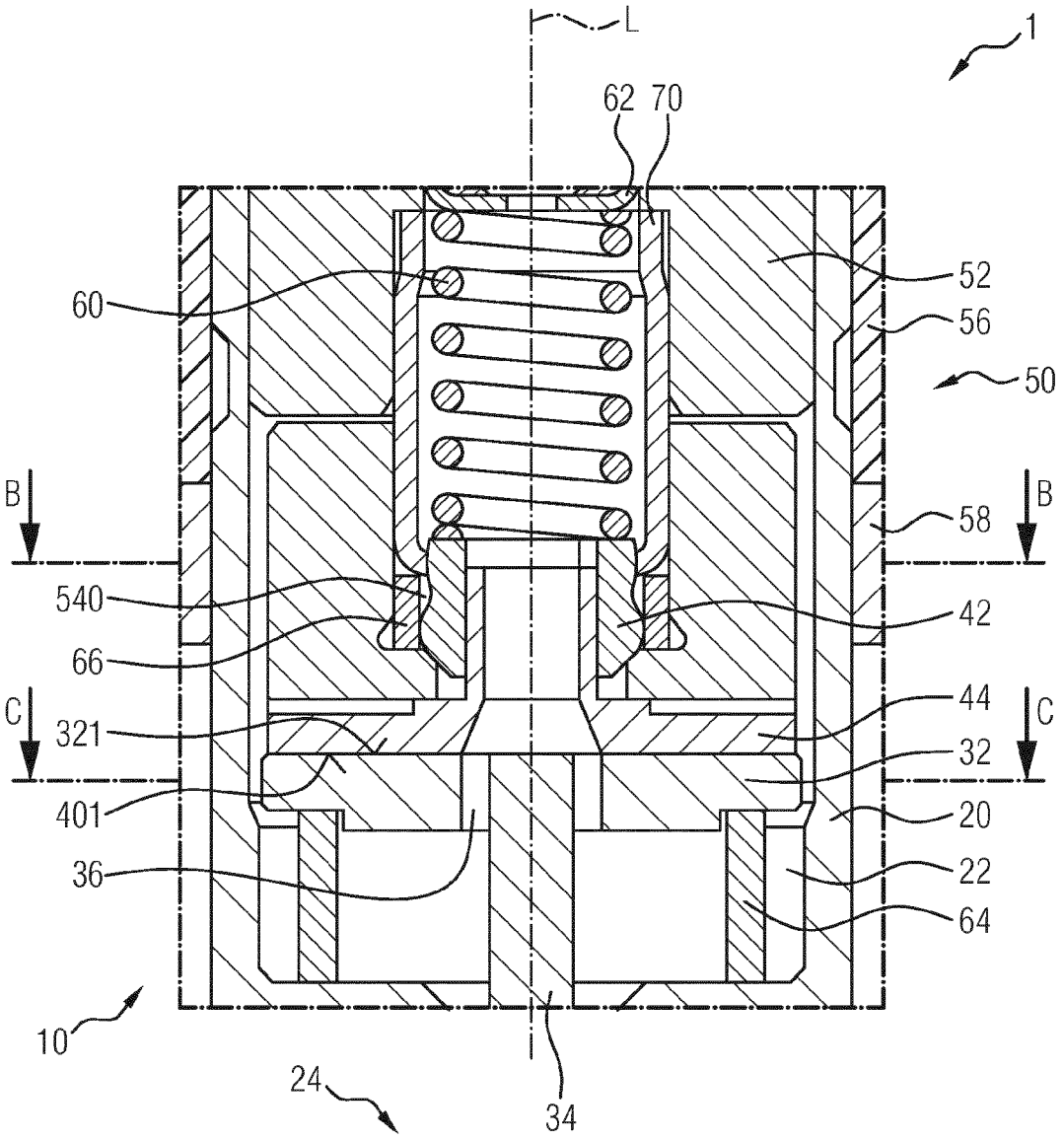
FIG. 4A shows a longitudinal section view of a portion of a fuel injection valve with a valve assembly according to teachings of the present disclosure.
Figure 4B:
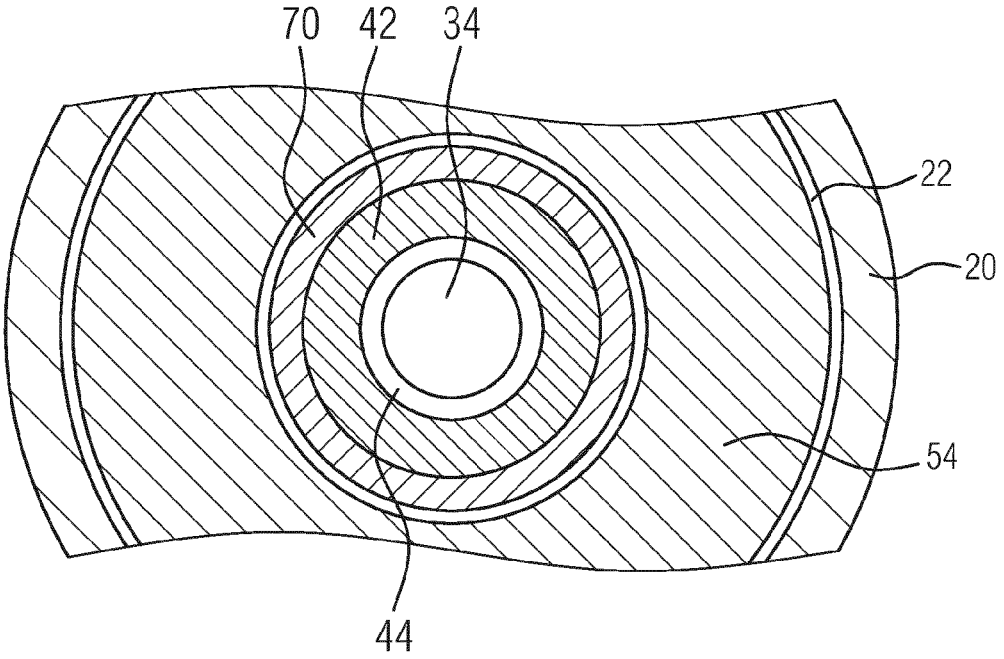
FIG. 4B shows a first cross-sectional view of the valve assembly.
Figure 4C:
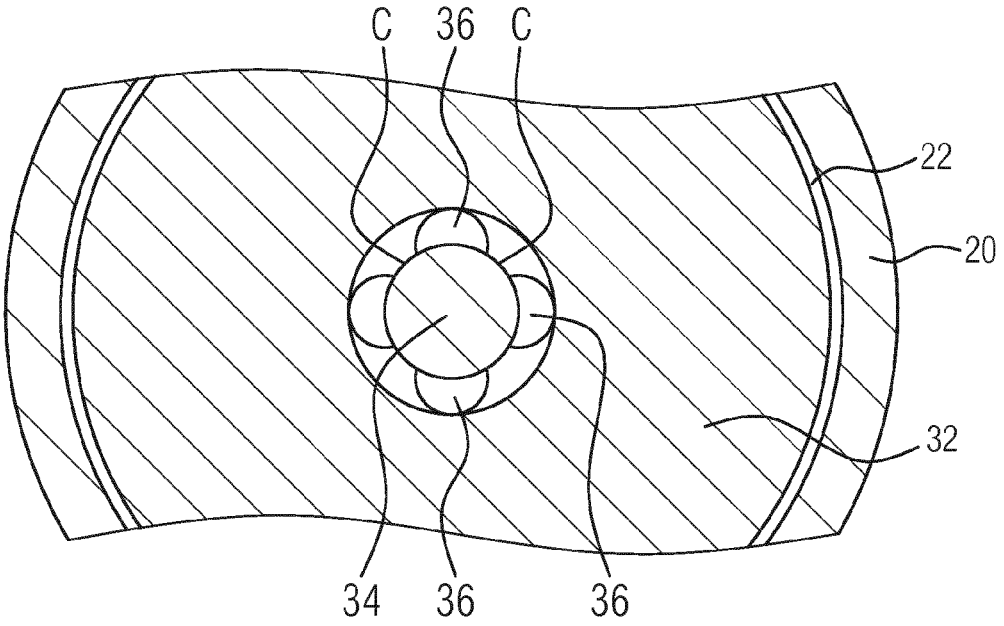
FIG. 4C shows a second cross-sectional view of the valve assembly.

FIGS. 4A, 4B and 4C show a fluid injection valve 1 with a valve assembly 10 according to the teachings of the present disclosure. FIG. 4A shows the fluid injection valve 1 in a longitudinal section view with respect to the longitudinal axis L of the valve body 20. FIG. 4B shows a cross-sectional view in the plane B-B indicated in FIG. 4A and FIG. 4C shows a cross-sectional view in the plane C-C indicated in FIG. 4A. The valve assembly 10 and the fluid injection valve 1 of FIG. 4 correspond in general to the fluid injection valve 1 and the valve assembly 10 of FIG. 1. However, in FIG. 4, the driving device 40 comprises an upper retainer element 42 and a lower retainer element 44 in addition to the armature 54. The valve spring 60 is seated against the calibration tube 62 and against the upper retainer element 42 on its opposite axial ends.

The upper retainer element 42 is arranged in the central aperture 540 of the armature 54. The guide sleeve 70 is also received in the central aperture 540 of the armature 54. The guide sleeve 70 and the upper retainer element 42 overlap axially and are positioned such that the guide sleeve 70 follows the upper retainer element 42 in radial outward direction. A curved portion of an outer circumferential surface of the upper retainer element 42 is in sliding mechanical contact with an inner circumferential surface of the guide sleeve 70 for axially guiding the upper retainer element. The armature 54 is axially guided by means of a sliding mechanical contact between an outer circumferential surface of the guide sleeve 70 and a circumferential surface of the central aperture 540 of the armature 54.

The lower retainer element 44 has a sleeve portion and a disc portion. The disc portion is positioned axially between the disc element 32 of the valve needle 30 and the armature 54. The sleeve portion extends from the disc portion into the central aperture 540 of the armature 54. The upper retainer element 42 is also in the shape of the sleeve and extends circumferentially around the sleeve portion of the lower retainer element 44. The upper retainer element 42 and the lower retainer element 44 are rigidly fixed to one another. Specifically, a press-fit connection and/or a welded connection is/are established between the sleeve portion of the lower retainer element 44 and the upper retainer element 42.

The armature 54 is axially displaceable relative to the retainer elements 42, 44, i.e. the armature 54 has an axial play relative to the retainer elements 42, 44. The armature 54—in particular a bottom surface of the central aperture 540—laterally overlaps the upper retainer element 42. In addition, the armature 54—in particular a bottom surface of the armature 54 remote from the pole piece 52—laterally overlaps the lower retainer element 44. In this way, the armature 54 is operable to engage in form-fit and/or force-fit connection with the upper retainer element 42 and with the lower retainer element 44.

The armature 54 and the first retainer element 42 have mutually facing inclined or curved surfaces—in particular a conical and a spherical surface, respectively—which are operable to engage in form-fit and force-fit connection. In FIG. 4, the armature 54 and the lower retainer element 44 are configured to engage into a form-fit connection by means of respective engagement surfaces of the armature 54 and the lower retainer element 44. The engagement surface of the armature 54 is in particular the bottom surface of the armature 54. The lower retainer element 44 has a surface facing towards the bottom surface of the armature 54 comprising a step.

The engagement surface of the lower retainer element 44 is a portion of said surface radially inside of the step. The portion of said surface which is arranged radially outside of the step is positioned further away from the bottom surface of the armature 54. In this way, an axial gap is established between the radial outside portion and the bottom surface of the armature. In some embodiments, the gap width of this gap is at least as large as the distance of the armature 54 from the pole piece 52 in the closed configuration of the valve assembly 10. For example, the gap width has a value of at least 200 μm, preferably of 500 μm or more. The distance of the step from an outer circumference of the lower retainer element 44 may be at least half of the distance of said outer circumference from the longitudinal axis L. In this way, a particularly small hydraulic sticking force between the armature 54 and the lower retainer element 44 is achievable. In addition, the retainer elements 42, 44 and the armature 54 are tiltable with respect to each other in this way to a certain extent.

By means of the form-fit and force-fit connection with the upper retainer element 42, the armature 54 is operable to move the retainer elements 42, 44 in the opening direction D. By means of the form-fit connection with the lower retainer element 44, armature 54 is operable to move the retainer elements 42, 44 in axial direction opposite to the opening direction D.

The valve assembly 10 further comprises an armature spring 66 which is arranged in the central aperture 540 of the armature 54 and seated against the guide sleeve 70 and the armature 54 on opposite axial ends so that it is preloaded. The armature spring 66 extends circumferentially around the upper retainer element 42. In this way, the armature spring 66 is configured and arranged to bias the armature 54 out of contact with the upper retainer element 42 when the actuator assembly 50 is not energized. When the valve assembly 10 is in the closed configuration, the armature spring 66 presses the armature 54 against the lower retainer element 44. In this way, a gap is established between the upper retainer element 42 and the bottom surface of the central aperture 540 of the armature 54.

When the actuator assembly 50 is energized so that the magnetic force generated by the coil 56 moves the armature 54 in the opening direction D (as described in detail in connection with the first embodiment), the armature 54 moves axially relative to the upper retainer element 42 until the gap between the latter and the bottom surface of the central aperture 540 is closed. During this travel of the armature 54, the upper retainer element 42 is retained in its position by the spring force of the valve spring 60 pressing the retainer elements 42, 44 which are rigidly fixed to one another onto the coupling surface 321 of the disc element 32.

When the armature 54 hits the upper retainer element 42, a large momentum is transferred to the retainer elements 42, 44. In this way, also a large momentum transfer to the valve needle 30 is achievable via the coupling surfaces 321, 401 of the driving device 40 and the disc element 32, as described in detail in connection with the first embodiment. In this way, the sealing element is displaced out of contact with the valve seat to open the fluid outlet end 24. Subsequently, armature 54 and the retainer elements 42, 44 move together in the opening direction D until the armature 54 hits the pole piece 52.

When the armature 54 hits the pole piece 52 at the end of the opening transient, the retainer elements 42, 44 can still move further in the opening direction D until the lower retainer element 44 comes into contact with the bottom surface of the armature 54.

This may contribute to dampen the impact of the driving device 40 on the pole piece 52 at the end of the opening transient even further.

Figure 5A:
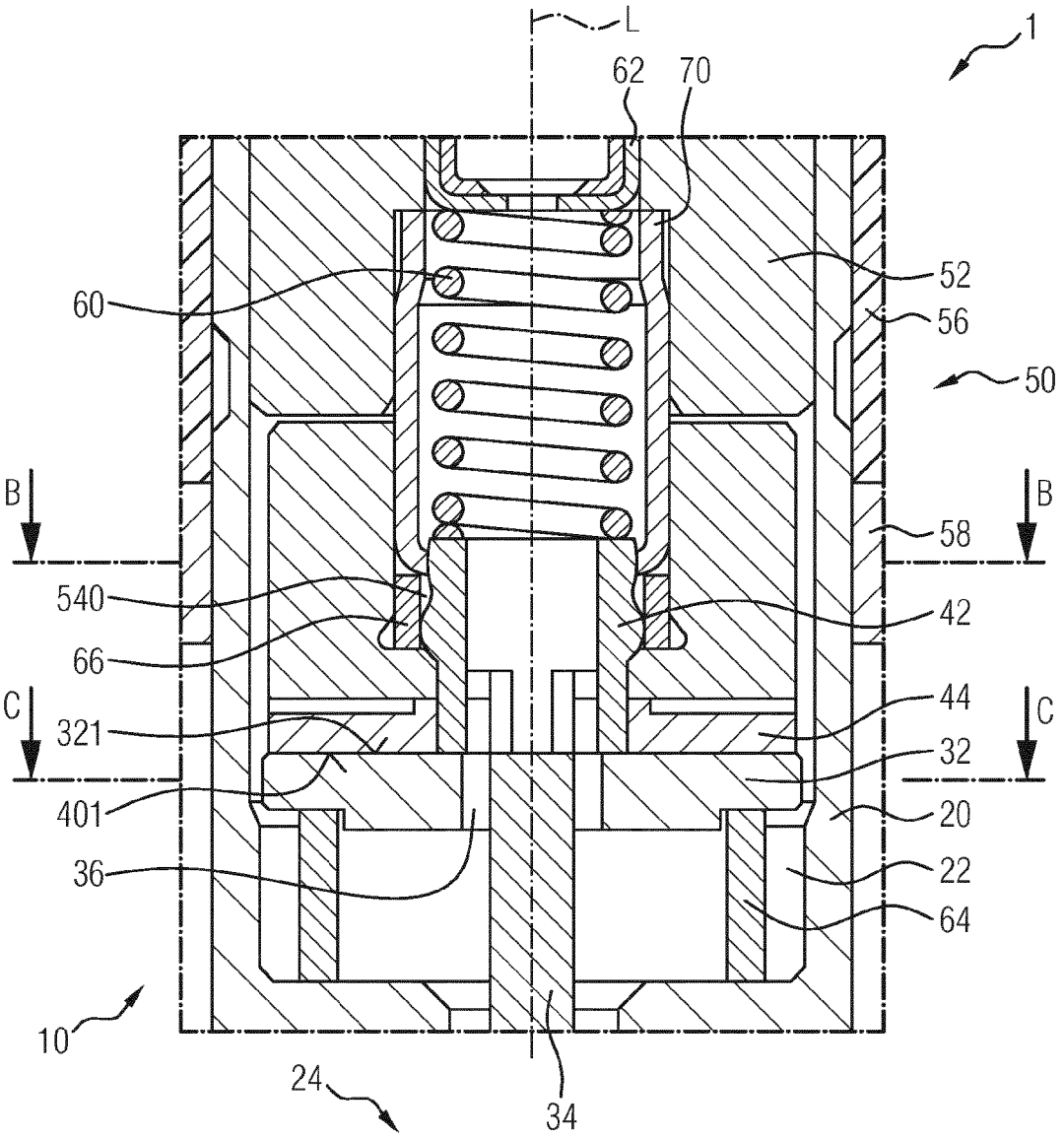
FIG. 5A shows a longitudinal section view of a portion of a fuel injection valve with a valve assembly according to teachings of the present disclosure.
Figure 5B:
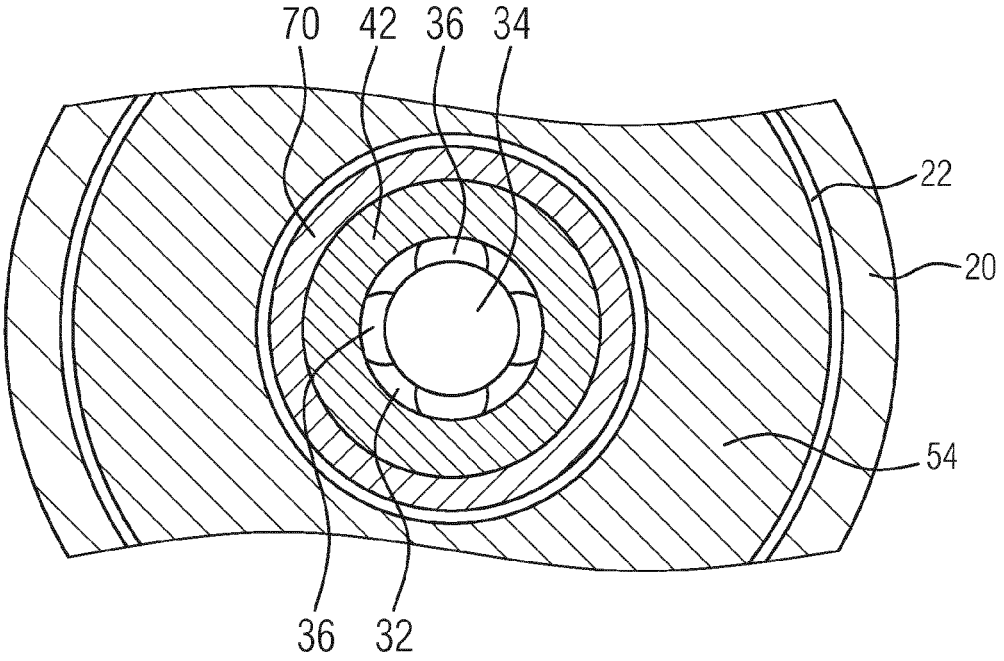
FIG. 5B shows a first cross-sectional view of the valve assembly.
Figure 5C:
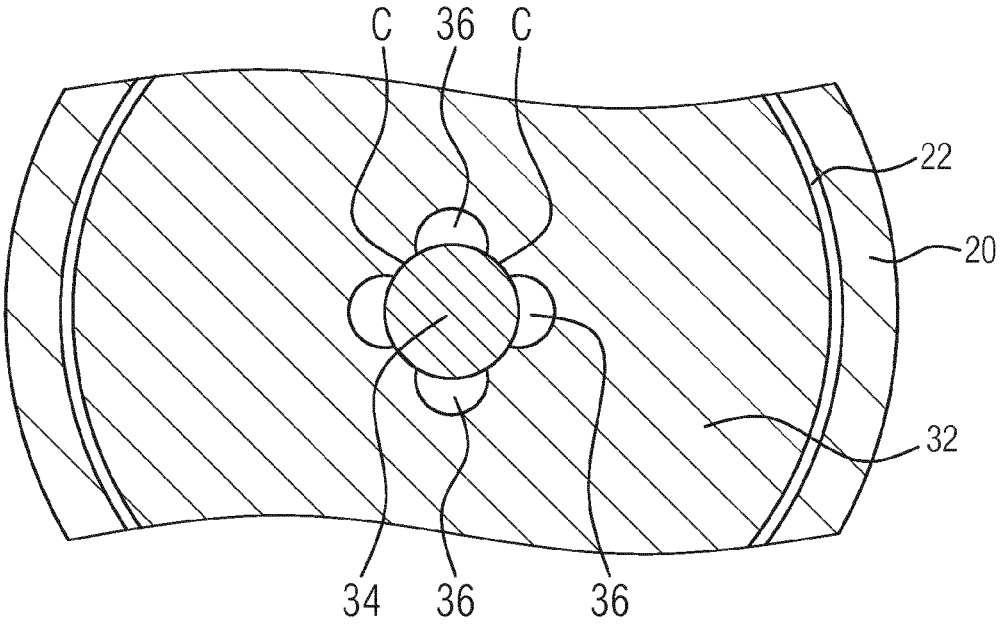
FIG. 5C shows a second cross-sectional view of the valve assembly.

FIGS. 5A, 5B and 5C show a fluid injection valve 1 with a valve assembly 10 according to teachings of the present disclosure. FIG. 5A shows the fluid injection valve 1 in a longitudinal section view with respect to the longitudinal axis L of the valve body 20. FIG. 5B shows a cross-sectional view in the plane B-B indicated in FIG. 5A and FIG. 4C shows a cross-sectional view in the plane C-C indicated in FIG. 5A. The valve assembly 10 and the fluid injection valve 1 of the fourth embodiment correspond in general to the fluid injection valve 1 and the valve assembly 10 of FIG. 4.

However, in FIG. 5, the lower retainer element 44 does not have a sleeve portion which extends into the central aperture 540 of the armature 54. Rather, the upper retainer element 42 protrudes axially beyond the armature 54 so that it has an end portion which is arranged downstream of the armature 54. This end portion of the upper retainer element 42 and the lower retainer element 44 overlap axially and a press-fit connection and/or welded connection is established between said end portion and the lower retainer element 44.

While the upper retainer element 42 extends circumferentially around the sleeve portion of the lower retainer element 44 in FIG. 4, the end portion of the upper retainer element 42 according to FIG. 5 is shifted into a central bore of the lower retainer element 44. In addition, the end portion has a plurality of slots which perforate the end portion in radial direction. At least a portion of the slots protrudes in axial direction beyond the lower retainer element 44. In this way, a particular large hydraulic diameter of the fluid path is achievable.

Although not explicitly mentioned in the discussion above, it is also conceivable to combine the second embodiment having a disc element 32 which is axially displaceable relative to the shaft 34 of the valve needle 30 with any of the third and fourth embodiments, resulting in a valve assembly 10 having a valve needle comprising the first and second stoppers 38, 39, the disc element 32 having an axial play between the first and second stoppers 38, 39 and, additionally, having a driving device 40 comprising the upper and lower retainer elements 42, 44 in addition to the armature 54, the armature 54 having an axial play relative to the upper and lower retainer elements 42, 44.

The concepts herein are not limited to specific embodiments by the description on basis of these exemplary embodiments. Rather, it comprises any combination of elements of different embodiments. Moreover, the teachings of the present disclosure include any combination of claims and any combination of features disclosed by the claims.

What is claimed is:

1. A valve assembly for a fluid injection valve, the valve assembly comprising:

a valve body with a longitudinal axis and a cavity;

a valve needle received in the cavity, operable to seal a fluid outlet end of the valve body in a closed position and moveable along the longitudinal axis away from the closed position in an opening direction for unsealing the fluid outlet end; and a driving device arranged in the cavity for displacing the valve needle, the driving device axially moveable relative to the valve body and to the valve needle;

wherein the valve needle comprises a disc element;

the disc element and the driving device comprise mutually facing and radially extending coupling surfaces, the coupling surfaces having an overlapping area of at least 35% of the cross-sectional area of the cavity;

the driving device takes the disc element with it for displacing the valve needle in the opening direction solely by means of hydraulic interaction between the coupling surfaces when the driving device is displaced in the opening direction; and the coupling surface of the driving device engages in a form-fit connection with the coupling surface of the disc element for pushing the valve needle towards the closed position.

2. A valve assembly according to claim 1, wherein the valve needle is does not limit axial displacement of the driving device relative to the valve needle in the opening direction.

3. A valve assembly according to claim 1, wherein the valve needle does not extend beyond the coupling surface of the disc element in the opening direction.

4. A valve assembly according to claim 1, wherein the driving device does not axially extend beyond its coupling surface opposite to the opening direction.

5. A valve assembly according to claim 3, wherein the driving device and the valve needle have no axial overlap.

6. A valve assembly according to claim 1, wherein the valve needle comprises a shaft and the disc element is fixed to an axial end of the shaft remote from the fluid outlet end.

7. A valve assembly according to claim 1, wherein the valve needle comprises:

a shaft;

a first stopper fixed to the shaft at a first axial end of the valve needle remote from the fluid outlet end; and a second stopper fixed to the shaft between the first stopper and a second axial end of the valve needle adjacent to the fluid outlet end;

wherein the disc element is axially displaceable relative to the shaft and positioned axially between the stoppers;

the disc element engages in form-fit and/or force-fit connection with the first stopper for moving the shaft in the opening direction; and the disc element engages in form-fit and/or force-fit connection with the second stopper for moving the shaft towards the closed position.

8. A valve assembly according to claim 1, further comprising:

a valve spring operable to bias the valve needle toward the closed position; and a sustaining spring arranged to bias the coupling surface of the disc element in axial direction towards the coupling surface of the driving device.

9. A valve assembly according to claim 1, further comprising an electromagnetic actuator assembly with a stationary pole piece and a moveable armature;

wherein the driving device comprises the armature.

10. A valve assembly according to claim 9, further comprising a guide sleeve for axially guiding the driving device or the armature;

wherein the pole piece includes a central axial opening, and the guide sleeve is received in the opening, fixed to the pole piece, and projects beyond the opening into a central aperture of the armature.

11. A valve assembly according to claim 9, wherein:

the driving device comprises an upper retainer element, a lower retainer element, and the armature;

the lower retainer element comprises the coupling surface of the driving device and is rigidly fixed to the upper retainer element;

the armature has an axial play relative to the retainer elements;

the armature engages in a form-fit and/or force-fit connection with the upper retainer element for displacing the upper and lower retainer elements in the opening direction; and the armature engages in a form-fit and/or force-fit connection with the lower retainer element for displacing the upper and lower retainer elements in axial direction opposite to the opening direction.

12. A valve assembly according to claim 11, further comprising an armature spring arranged to bias the armature out of contact with the upper retainer element.

13. A valve assembly according to claim 11, further comprising a guide sleeve for axially guiding the driving device or the armature, wherein the guide sleeve is positioned radially between the upper retainer element and the armature.

* * * * *